United States Patent [19]

Bardenhagen et al.

[11] 4,044,659

[45] Aug. 30, 1977

[54] APPARATUS FOR MAKING COMPOSITE FILTER PLUGS

[75] Inventors: Dietrich Bardenhagen; Helmut Niemann, both of Hamburg; Wolfgang Steiniger, Bornsen; Gerhard Tolasch; Wolfgang Wiese, both of Hamburg, all of Germany

[73] Assignee: Hauni-Werke Korber & Co. KG, Hamburg, Germany

[21] Appl. No.: 622,333

[22] Filed: Oct. 14, 1975

[30] Foreign Application Priority Data

Oct. 15, 1974 United Kingdom ..... 44544/74

[51] Int. Cl.[2] ..... B65G 47/32

[52] U.S. Cl. ..... 93/77 FT; 198/343

[58] Field of Search ..... 93/1 C, 77 FT; 198/20 C

[56] References Cited

U.S. PATENT DOCUMENTS

| | | | |
|---|---|---|---|
| 2,953,878 | 9/1960 | Schur | 93/1 C UX |
| 3,370,514 | 2/1968 | Rome | 93/1 C |
| 3,521,513 | 7/1970 | Gömann et al. | 83/154 X |
| 3,834,285 | 9/1974 | Schubert et al. | 93/1 C |
| 3,872,779 | 3/1975 | Jackson | 93/1 C |

*Primary Examiner*—James F. Coan
*Attorney, Agent, or Firm*—Peter K. Kontler; John Kurucz

[57] ABSTRACT

Apparatus for producing composite filter plugs for cigarettes or other smokers' products has two sets of conveyors which feed filter rod sections of different types to the flutes of a rotary assembly conveyor. The latter assembles the sections into groups each having a section of first and second type and moves the groups to an auxiliary conveyor which transports the groups sideways to successive pneumatic holders of a transfer conveyor. The transfer conveyor has two carriers which rotate about parallel axes and are coupled to each other by linkages, one for each holder. The linkages cause the holders to rotate relative to that carrier which supports the holders so that the orientation of holders remains unchanged during travel through 90° or 270° when the groups are taken over by successive increments of a web which is moved lengthwise and is draped around the resulting rod-like filler to form therewith a rod. The rod is severed to yield composite filter plugs each having a section of the first type and a section of the second type.

2 Claims, 7 Drawing Figures

Fig. 1
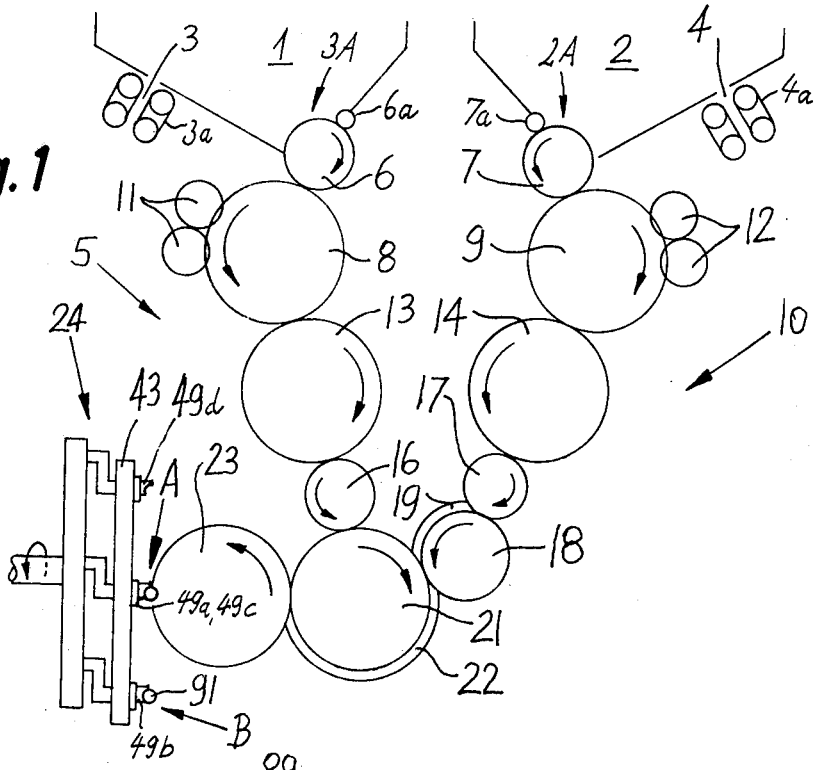
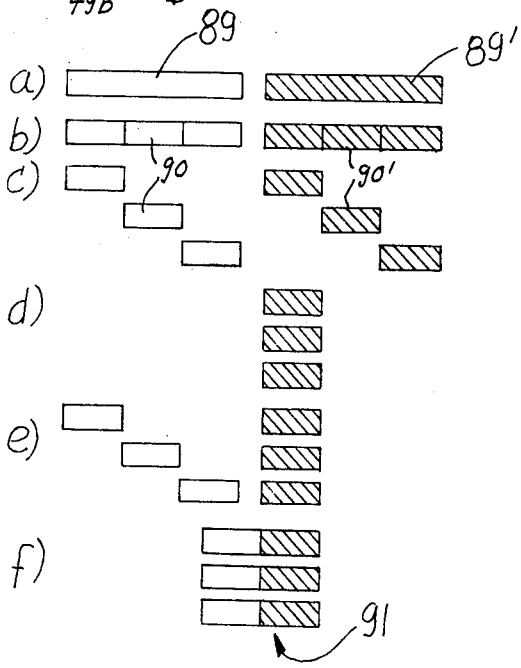
Fig. 2

APPARATUS FOR MAKING COMPOSITE FILTER PLUGS

BACKGROUND OF THE INVENTION

The present invention relates to apparatus for producing composite rod-like filter plugs for cigarettes, cigars or cigarillos.

U.S. Pat. No. 2,953,878 discloses an apparatus wherein groups of filter rod sections are fed sideways in front of successive entraining members of a chain so that the groups form a continuous rod-like filler which is wrapped to form with the wrapper a rod ready to be subdivided into discrete filter plugs. The groups contain filter rod sections consisting of different materials. The just mentioned apparatus exhibits the drawback that it cannot be operated at a high speed because the trailing ends of successive groups would undergo excessive deformation in response to engagement with entraining members of the chain.

SUMMARY OF THE INVENTION

An object of the invention is to provide a novel and improved apparatus which can produce composite filter plugs at a high speed, with a high degree of reproducibility and without any deformation of and/or other damage to components of the plugs.

Another object of the invention is to provide the apparatus with novel and improved transferring means for changing sidewise movement of groups of coaxial filter plugs into axial movement at a high speed and without damage to the rearmost sections of the groups.

A further object of the invention is to provide the apparatus with novel and improved means for feeding groups of filter rod sections directly to the transferring means.

The invention is embodied in an apparatus for producing composite or multiplex filter plugs for use with cigarettes or the like. The apparatus comprises means for assembling rod-like filter sections of several types into groups of assorted coaxial filter sections which move sideways toward a first station. The assembling means includes a discrete set of conveyors for the sections of each type and preferably a single assembly conveyor which transports a series of groups sideways, and the apparatus further comprises means (preferably a rotary transfer conveyor) for transferring successive groups from the first station to a second station where the groups move axially. The transferring means comprises a rotary carrier having at least one eccentric holder arranged to accept groups at the first station and to transport the thus accepted groups to the second station, and means including a linkage for turning the holder with respect to the carrier during rotation of the carrier so as to maintain the holder in parallelism with groups arriving at the first station and to thereupon maintain the orientation of the holder substantially unchanged during travel from the first to the second station. Still further, the apparatus comprises a filter rod making machine or analogous means for converting the groups arriving at the second station into a continuous rod-like filler, for moving the filler axially, for draping the filler into a web to form a continuous filter rod, and a cutoff or analogous means for subdividing the filter rod into discrete rod-like plugs each of which contains a section of each of the several types.

The novel features which are considered as characteristic of the invention are set forth in particular in the appended claims. The improved apparatus itself, however, both as to its construction and its mode of operation, together with additional features and advantages thereof, will be best understood upon perusal of the following description of certain specific embodiments with reference to the accompanying drawing.

BRIEF DESCRIPTION OF THE DRAWING

FIG. 1 is a side elevational view of a group assembling unit of an apparatus which embodies one form of the invention;

FIG. 2 shows various stages of transformation of several types of filter rod sections into groups of assorted filter elements;

DESCRIPTION OF THE PREFERRED EMBODIMENTS

Figure 3:
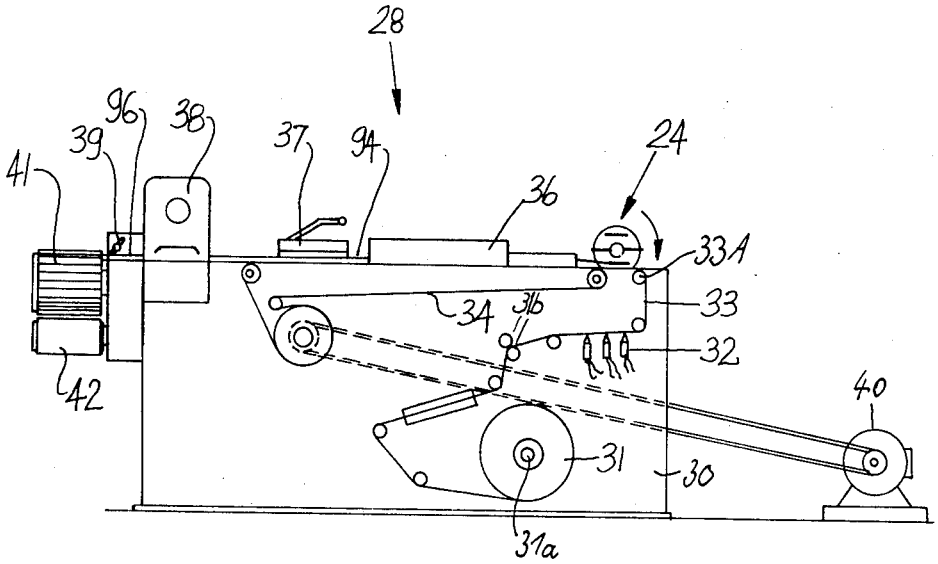
FIG. 3 is a side elevational view of a filter rod making machine forming part of the apparatus including the assembling unit of FIG. 1.

Referring first to FIG. 1, there is shown a group assembling unit forming part of an apparatus for making a series of composite filter plugs 96 shown in FIG. 3. The assembling unit comprises two sets 5 and 10 of conveyors which feed first types of filter rod sections 90 of unit length and second types of filter rod sections 90' of unit length to a common rotary assembly conveyor 21.

The set 5 of the assembling unit of FIG. 1 receives material from a magazine or hopper 1 for a supply of parallel filter rod sections 89 (FIG. 2*a*) of three times unit length. The magazine 2 has an inlet opening 3 which is located at a level slightly above an outlet 3A and receives sections 89 from a sender including two driven endless belts 3*a*. The sender which feeds sections 89 into the magazine 1 may be of the type known as FT produced by Hauni-Werke Korber & Co. K.G. of Hamburg, Federal Republic Germany. The outlet 3A of the magazine 1 receives a portion of a fluted rotary drum-shaped withdrawing conveyor 6 cooperating with a refuser roller 6*a* and serving to withdraw from the magazine a row of equally spaced sections 89 which travel sideways toward the transfer station between the conveyor 6 and a fluted rotary drum-shaped severing conveyor 8. The latter cooperates with two rotary disk-shaped knives 11 to subdivide each section 89 into three shorter sections 90 (FIG. 2*b*) of unit length. The thus obtained groups, each of which consists of three coaxial sections 90, are transferred onto a staggering conveyor 13 having three rotary drums which rotate at different speeds and/or transport the respective sections 90 of each group through different distances so that the sections 90 of each group are staggered in a manner as shown in FIG. 2*c*. The drums of the staggering conveyor 13 deliver sections 90 to successive flutes of a rotary drum-shaped inserting conveyor 16 which transports the sections 90 sideways (see FIG. 2*e*) and inserts them into successive flutes of the assembly conveyor 21.

The set 10 of the assembling unit of FIG. 1 receives material from a magazine or hopper 2 having an inlet opening 4 and an outlet 4A, and a sender including two belts 4a which feed to the magazine 4 filter rod sections 89' of three times unit length (see FIG. 2a). The filter material of the sections 89' is different from the material of sections 89. The set 10 further comprises a withdrawing conveyor 7a serving to deliver sections 89' into successive flutes of a rotary drum-shaped serving conveyor 9 which cooperates with two rotary disk-shaped knives 12 to subdivide each section 89' into three coaxial sections 90' of unit length (see FIG. 2b). Successive groups of three coaxial sections 90' are accepted by the respective drums of a rotary staggering conveyor 14 whose operation is analogous to that of the conveyor 13 (see FIG. 2c) and which delivers discrete sections 90' into successive flutes of a rotary drum-shaped intermediate conveyor 17. The latter delivers successive sections 90' into successive flutes of a rotary drum-shaped shuffling conveyor 18 cooperating with one or more fixed cams 19 to shift at least some of the sections 90' axially so that such sections form a single row (FIGS. 2d and 2e) wherein each proceding section 90' is in exact register with the next-following section. The thus shuffled sections 90' are fed into successive flutes of the assembly conveyor 21 downstream of the locus where the flutes of the conveyor 21 receive discrete sections 90. The conveyor 21 travels past one or more stationary cams 22 which shift the sections 90 and/or 90' axially so that each section 90 forms part of a group 91 of two filter sections the other of which is one of the sections 90' (see FIG. 2f).

The assembly conveyor 21 delivers successive groups 91 to successive flutes of a rotary drum-shaped auxiliary conveyor 23 which, in turn, delivers successive groups 91 to successive elongated pneumatic holders 49a, 49b, 49c, 49d, of a rotary transfer conveyor 24. The latter receives groups 91 at a first transfer station A and transports each group through an angle of substantially 90° to a second transfer station B prior to depositing the group on the adhesive-coated upper side of a web 33 of cigarette paper, imitation cork or other suitable wrapping material (see FIG. 3).

Figure 4:
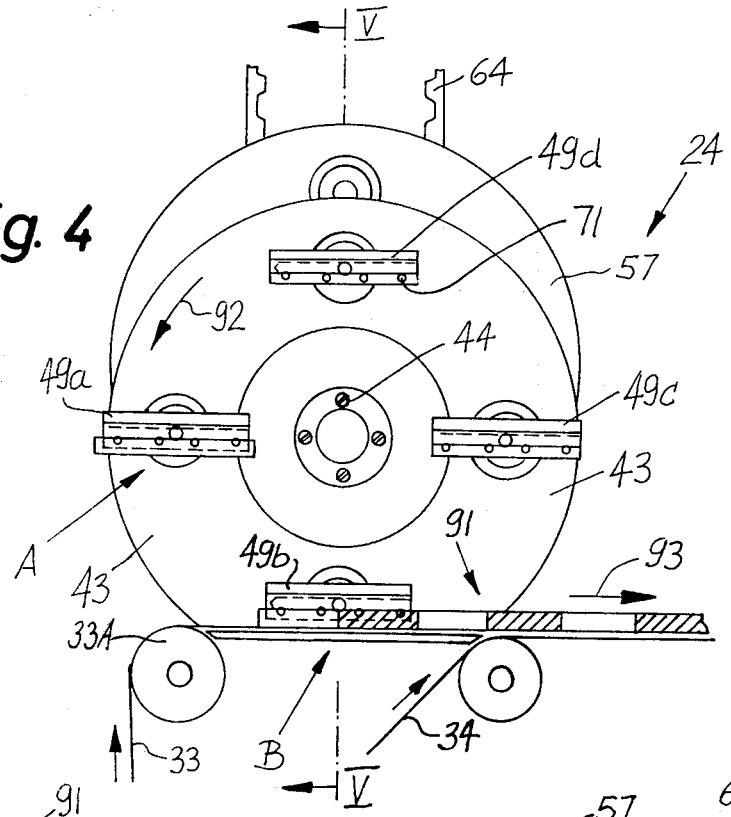
FIG. 4 is an enlarged view of a detail in FIG. 3.

FIGS. 3 and 4 show that the transfer conveyor 24 delivers groups 91 to the station B in such a way that the groups begin to move axially or lengthwise (arrow 93) whereby the groups form a continuous rod-like filler wherein sections 90 alternate with sections 90'. The filler is formed in the filter rod making machine 28 of FIG. 3 which comprises a frame 30, a spindle 31a for a roll 31 of convoluted web material, driven advancing rolls 31b which draw the web 33 off the roll 31, several paster nozzles 32 which coat one side of the web 33 with a suitable adhesive (the adhesive may be a wet adhesive or a hotmelt), an endless belt 34 of the type known as garniture, a wrapping mechanism 36 which drapes the web 33 around the filler consisting of groups 91 so that the marginal portions of the web 33 overlap each other and form a continuous seam extending lengthwise of the resulting filter rod 94, a sealer 37 which heats the seam if the adhesive is a wet adhesive and cools the seam if the adhesive is a hot melt to thus strengthen the seam, a cutoff 38 or an analogous mechanism which subdivides the rod 94 into discrete filter plugs 96, a rotary accelerating cam 39 which propels successive plugs 96 into successive flutes of a rotary drum-shaped row forming conveyor 41, and a take-off conveyor 42 (e.g., an endless belt) which transports one or more rows of plugs 96 to a further processing station, e.g., to a filter cigarette making machine.

The machine 28 further comprises a prime mover 40 (e.g., a variable-speed electric motor) which drives the garniture 34, the advancing rolls 31b, the mobile parts of the cutoff 38, the cam 39, the conveyors 41, 42 as well as the conveyors shown in FIG. 1.

Figure 5:
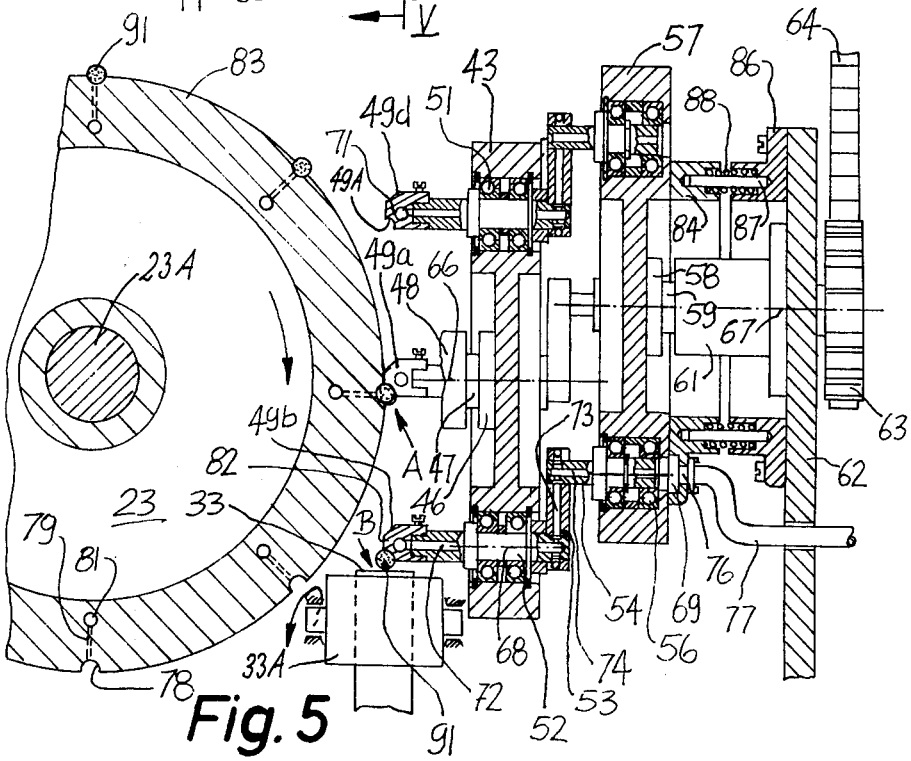
FIG. 5 is a sectional view as seen in the direction of arrows from the line V—V of FIG. 4.

The transfer conveyor 24 is shown in detail in FIGS. 4 and 5. This conveyor comprises a first rotary carrier 43 which is connected with a flange 46 by means of screws 44 or analogous fasteners. The flange 46 is rigid with a shaft 47 which is rotatable in a fixed bearing housing 48. The latter is supported by the frame 30 of the machine 28. The carrier 43 supports four equally spaced elongated pneumatic holders or suction heads 49a, 49b, 49c, 49d for discrete groups 91. The distance between the axis of the shaft 47 and the pivot axes of the holders 49a –49d is the same and all four holders are always parallel to each other and to that portion of the web 33 which extends between the upper stretch of the garniture 34 and a guide roller 33A for the web. The shafts 52 of the holders 49a–49d rotate in antifriction ball bearings 51 which are mounted in the carrier 43. The holders 49a–49d are disposed at one side of the carrier 43, and each of the shafts 52 extends through the carrier and is rigid with one end of a discrete link 53. The links 53 are located at the other side of the carrier 43 and the other end of each link is rigid with a shaft 54 rotatable in antifriction ball bearings 56 mounted in a second rotary carrier 57 whose axis 67 is parallel to the axis 66 of the shaft 47. The carrier 57 is rigid with a flange 58 having a shaft 59 whose axis coincides with the axis 67 and which is rotatable in a bearing housing 61 secured to a plate-like frame member 62 of the frame 30. The shaft 59 is rigid with a gear 63 which is driven by a toothed belt 64 receiving motion from the prime mover 40 in synchronism with other mobile parts of the machine 28. The parts 63, 64 can be said to constitute a drive means for the transfer conveyor 24. The distance between the axes 67, 66 is the same as the distance between the axis 68 of a shaft 52 and the axis 69 of the associated shaft 54. All of these axes are parallel to each other. The flutes 49A of all four holders 49a–49d are parallel to each other.

The holders 49a–49d have suction ports 71 which communicate with channels 72 machined into the respective shafts 52. The channels 72 communicate with channels 73 in the respective links 53 and with channels 74 in the respective shafts 54. The channels 74 communicate at times with an arcuate groove 76 which is machined into a stationary ring-shaped valve plate 84 surrounding the shaft 59. The groove 76 extends along an arc of approximately 90° (between the stations A and B) and is connected with a fan or another suitable suction generating device by means of a suction pipe 77.

The auxiliary conveyor 23 has a cylindrical peripheral surface 83 with flutes 78 which are parallel to the axis of a drive shaft 23A. The flutes 78 communicate with suction ports 79 which, in turn, communicate with channels 81 extending in parallelism with the axis of the shaft 23A and connected with a suction generating device (not shown) during travel of respective flutes 78 from the transfer station between the conveyors 22, 23 to the transfer station A. The holders 49a–49d on the carrier 43 have front end faces 82 which are immediately adjacent to the respective flutes 49A and are adjacent to or abut against the peripheral surface 83 during travel past the transfer station A. The distance between two neighboring flutes 78 (as considered in the circumferential direction of the conveyor 23) equals the distance between two neighboring holders 49a–49d, as considered in the direction indicated by arrow 92 shown in FIG. 4.

The frame member of the frame 30 which supports the bearing housing 48 for the shaft 47 has been omitted for the sake of clarity. The linkages 52, 53, 54 rotate the carrier 43 in response to rotation of the carrier 57.

The ring-shaped valve plate 84 is biased against the adjacent surface of the carrier 57 by helical springs 88 surrounding elongated pins 87 which are reciprocably received in registering sockets of the valve plate 84 and a ring 86 bolted to the frame member 62. The springs 88 insure that the valve plate 84 bears against the carrier 57, i.e., that the groove 76 is sealed from the atmosphere.

The operation:

The magazines 1 and 2 respectively contain supplies of parallel sections 89 and 89'. Such sections are fed into the magazines 1, 2 by the respective senders via inlet openings 3, 4 and the conveyors 6, 7 withdraw sections 89, 89' at regular intervals (FIG. 2a) to deliver the withdrawn sections into the flutes of the severing conveyors 8, 9 which cooperate with the knives 11, 12 to respectively convert the sections 89, 89' into groups of coaxial sections 90, 90' (FIG. 2b). The conveyors 13, 14 thereupon stagger the groups of sections 90, 90' in a manner as shown in FIG. 2c, and the sections 90 remain staggered during travel with the flutes of the conveyor 16. The sections 90' are transported by the conveyor 17 and thereupon by conveyor 18 which cooperates with the cam or cams 19 to convert each group of sections 90' into a row (see the right hand portion of FIG. 2d).

The conveyor 16 delivers discrete sections 90 into successive flutes of the assembly conveyor 21, and each such flute thereupon receives a section 90' (FIG. 2e). The conveyor 21 transports the thus received sections 90, 90' past the cam or cams 22 to form a series of groups 91 wherein the sections 90 abut the respective sections 90'. The groups 91 are taken over by the auxiliary conveyor 23 which transports them sideways toward the station A where they enter successive holders of the transfer conveyor 24. In FIGS. 4 and 5, the holder 49a is located at the station A and its suction port or ports 71 attract the group 91 in the adjacent flute 78 of the auxiliary conveyor 23. The group 91 then moves in the direction indicated by arrow 92 and arrives at the station B while its sections 90, 90' move axially (arrow 93). The orientation of the holder 49a remains unchanged, i.e., the holder remains horizontal. However, instead of extending radially of the carrier 43 (see FIG. 4), the holder 49a is tangential to this carrier when it reaches the station B. In other words, the group 91 in the holder 49a is parallel to the adjacent portion of the web 33. The holder 49a is maintained in parallelism with itself by the respective linkage 52–54 which rotates the holder 49a clockwise, as viewed in FIG. 4, while the carrier 43 rotates anticlockwise (arrow 92) in order to advance the holder 49a from the station A to the station B.

At the station B, the speed of the group 91 in the holder 49a equals or slightly exceeds the speed of lengthwise movement of the web 33 and garniture 34 in the direction indicated by arrow 93. The suction port or ports 71 of the holder 49a are sealed from the groove 76 as soon as the holder 49a reaches the station B so that the group 91 adheres to the adhesive-coated upper side of the web 33 and advances therewith toward the upper reach of the garniture 34. The manner in which the holders 49b, 49c, 49d receive, transport and deliver groups 91 is the same as described with reference to the holder 49a. Thus, the web 33 transports a continuous rod-like filler which consists of groups 91, i.e., of alternating sections 90, 90' and such filler is confined in the web 33 during travel through the wrapping mechanism 36 to form with the web a continuous rod 94. The seam of the tubular wrapper of the rod 94 is heated or cooled by the sealer 37 (depending on the nature of adhesive supplied by the paster nozzles 32), and the rod 94 is thereupon severed by the cutoff 38 to yield a single file of plugs 96 which are accelerated by the cam 39 to form one or more rows during travel with the conveyor 41. Such row or rows are transferred onto the take-off conveyor 42. Each plug 96 contains a section 90 and a section 90', i.e., each plug includes a group 91 plus a tubular portion of the web 33.

Figure 6:
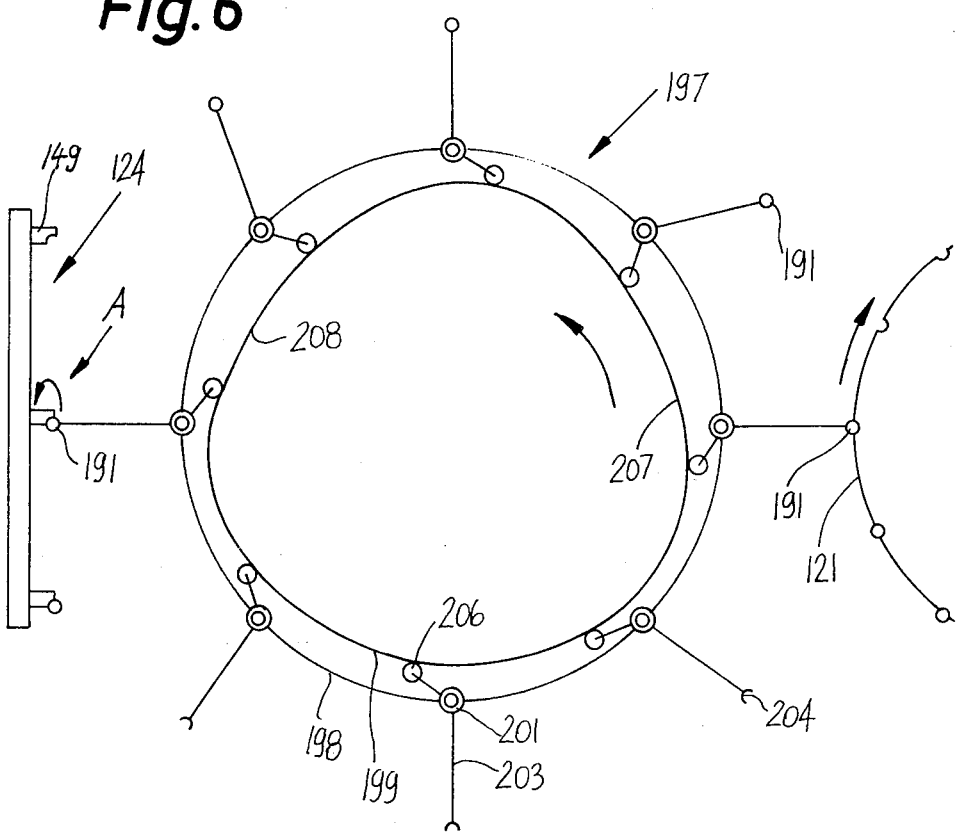
FIG. 6 is a schematic elevational view of a portion of a second group assembling unit.
Figure 7:
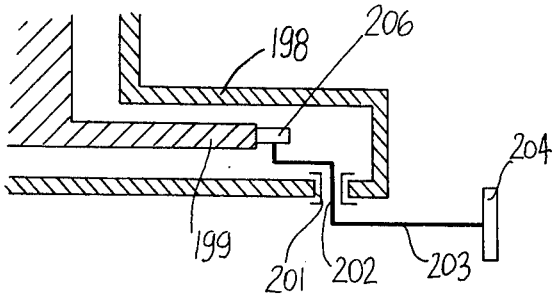
FIG. 7 is a sectional view of a detail in the structure of FIG. 6.

FIGS. 6 and 7 show an auxiliary conveyor 197 which constitutes a modification of the conveyor 23. All such parts of the conveyor 197 which are identical with or analogous to the corresponding parts of the conveyor 23 are denoted by similar reference characters plus 100. The conveyor 197 comprises an annular rotor 198 which surrounds a stator 199 constituting a fixed disk-shaped cam. The rotor 198 has equally spaced bearings 201 for shafts 202 which carry pivotable or turnable elongated trough-shaped holders 203 for groups 191. The outer ends of the holders 203 have sockets or flutes 204 for discrete groups 191. The sockets 204 have suction ports analogous to suction ports 71 of the holders 49a–49d. Each holder 203 constitutes a two-armed lever the outer arm of which carries the respective socket 204 and the inner arm of which carries a roller-follower 206 tracking the periphery of the cam 199.

The operation is as follows:

Successive sockets 204 receive groups 191 from successive flutes of the assembly conveyor 121 while the rotor 198 rotates anticlockwise, as viewed in FIG. 6. The peripheral speed of the assembly conveyor 121 is relatively low, and the speed of holders 149 of the transfer conveyor 124 is higher. Therefore, the roller followers 206 of holders 203 which approach the transfer station between the conveyors 121, 197 track an inwardly sloping portion 207 of the periphery of the cam 199. The roller followers 206 thereupon track an outwardly sloping portion or lobe 208 of the cam 199 so that the speed of sockets 204 containing groups 191 increases and equals the speed of holders 149 at the transfer station A. In all other respects, the operation of the apparatus embodying the structure of FIG. 6 is identical with that of the apparatus including the conveyors 21, 23, 24.

The main purpose of the cam 199 is to change the distance between the holders 203 during travel from the assembly conveyor 121 to the station A.

If the apparatus including the structure of FIG. 6 is to be converted for the making of shorter or longer plugs, the stator or cam 199 is replaced with a cam having a different lobe 208 and the transfer conveyor 124 is replaced with a conveyor wherein the holders 149 are respectively nearer to or more distant from each other. Also, the speed of the conveyor replacing the conveyor 124 is lower or higher, depending upon whether the apparatus is to turn out shorter or longer plugs. The speed of the assembly conveyor 121 (and hence the slope of the portion 207 of the stator) can remain unchanged.

An advantage of the improved apparatus is that it can convert sidewise movement of groups 91 or 191 into axial movement at a surprisingly high speed and that the sections of the groups 91 or 191 (as well as the groups) are treated gently in spite of the high speed at which the filter rod making machine produces a continuous rod.

A further advantage of the improved apparatus is that it can produce a filter rod wherein the sections are invariably disposed end-to-end (i.e., without any clearance between neighboring sections) so that the cutoff 38 can readily form a series of plugs each of which contains a complete section of a first type and a complete section of a second type. The operation of the apparatus is smooth and the quality of plugs is highly satisfactory.

Still another advantage of the apparatus is that it can be readily converted for the making of shorter or longer plugs with little loss in time and by requiring a relatively small number of spare components.

The apparatus is susceptible of many modifications without departing from the spirit of the invention. For example, the assembly conveyor 21 or 121 can receive three or more types of sections of unit length. Also, the length of sections 90 need not equal the length of sections 90'. Still further, one section of each group can contain a fibrous filter material and the other section or sections of each group can contain a different filter material or fibrous material plus another filter material. The distance between the stations A and B may be less or more than 90°.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for the production of composite filter plugs for cigarettes or the like, comprising means for assembling rod-like filter sections of several types into groups of assorted coaxial filter sections which move sideways toward a first station, including a discrete set of conveyors for the sections of each of said types; an auxiliary conveyor having a plurality of holder means for transferring groups directly to said first station and means for changing the distance between said holder means; means for transferring successive groups from said first station to a second station where said groups move axially, including a rotary carrier having at least one eccentric holder arranged to accept groups at said first station and to transport the thus accepted groups to said second station and means including a linkage for turning said holder with respect to said carrier during rotation of the carrier so as to maintain said holder in parallelism with groups arriving at said first station and to thereupon maintain the orientation of said holder substantially unchanged during travel from said first to said second station; means for converting the groups arriving at said second station into a continuous rod-like filler, for moving the filler axially and for draping the filler into a web to form a continuous filter rod; and means for subdividing the filler rod into discrete rod-like plugs each of which contains a section of each of said types.

2. Apparatus as defined in claim 1, wherein said auxiliary conveyor further comprises a rotor pivotably supporting said holder means and said means for changing said distance comprises a stator having a cam face tracked by said holder means.

* * * * *